US008746451B2

(12) United States Patent
Nicholls et al.

(10) Patent No.: US 8,746,451 B2
(45) Date of Patent: Jun. 10, 2014

(54) CIRCULAR SAW BLADE PROTECTOR

(75) Inventors: Matthew Nicholls, Spring, TX (US); Melvin A. Pendergraph, Arlington Heights, IL (US)

(73) Assignee: Robert Bosch GmbH, Stuttgart (DE)

( * ) Notice: Subject to any disclaimer, the term of this patent is extended or adjusted under 35 U.S.C. 154(b) by 94 days.

(21) Appl. No.: 13/096,534

(22) Filed: Apr. 28, 2011
(Under 37 CFR 1.47)

(65) Prior Publication Data

US 2012/0273376 A1 Nov. 1, 2012

(51) Int. Cl.
*A45C 11/26* (2006.01)

(52) U.S. Cl.
USPC ..... 206/349; 206/303; 206/1.5

(58) Field of Classification Search
USPC ..... 206/349, 303, 372, 806, 445, 775, 825, 206/1.7, 807, 1.5; 220/4.21, 4.24
See application file for complete search history.

(56) References Cited

U.S. PATENT DOCUMENTS

| | | | | |
|---|---|---|---|---|
| 102,923 | A | 5/1870 | Disston | |
| 716,785 | A | 12/1902 | Taylor | |
| 2,344,919 | A * | 3/1944 | Kelly | 206/309 |
| 2,601,426 | A | 6/1952 | Baumann | |
| 4,457,445 | A * | 7/1984 | Hanks et al. | 220/214 |
| 4,811,998 | A * | 3/1989 | Rankin | 312/229 |
| 6,161,693 | A * | 12/2000 | Findle et al. | 206/349 |
| 6,267,239 | B1 | 7/2001 | Maki | |
| D469,354 | S | 1/2003 | Curtsinger | |
| 6,547,066 | B2 * | 4/2003 | Koch | 206/308.1 |
| 6,729,468 | B1 | 5/2004 | Dobmeier | |
| 6,874,635 | B2 | 4/2005 | Curtsinger | |
| 6,910,575 | B2 | 6/2005 | Curtsinger et al. | |
| 7,815,044 | B2 | 10/2010 | Kasubowski et al. | |
| 7,937,975 | B2 * | 5/2011 | Kolton et al. | 70/57.1 |
| 2007/0062903 | A1 * | 3/2007 | Norman et al. | 215/274 |
| 2009/0120934 | A1 * | 5/2009 | Domkowski | 220/253 |
| 2010/0072093 | A1 * | 3/2010 | Cross | 206/349 |
| 2010/0251276 | A1 * | 9/2010 | Thomas et al. | 720/719 |

OTHER PUBLICATIONS

International Search Report and Written Opinion in corresponding PCT Application (i.e., PCT/US2012/034275), mailed Jun. 15, 2012 (15 pages).

* cited by examiner

*Primary Examiner* — Jacob K Ackun
*Assistant Examiner* — Jenine Pagan
(74) *Attorney, Agent, or Firm* — Maginot, Moore & Beck

(57) ABSTRACT

A protector assembly includes a first shield segment defining a first blade space. The first shield segment includes a first channel structure defining a first channel facing the first blade space. The protector assembly further includes a second shield segment defining a second blade space. The second shield segment includes a second channel structure defining a second channel facing the second blade space. The first shield segment further includes (i) a first end portion that includes a first coupling structure, and (ii) a second end portion that includes a second coupling structure. The second shield segment further includes (i) a third end portion that includes a third coupling structure, and (ii) a fourth end portion that includes a fourth coupling structure. When the first end portion of the first shield segment is positioned adjacent to the third end portion of the second shield segment, the first coupling structure cooperates with the third coupling structure to couple the first end portion to the third end portion. When the second end portion of the first shield segment is positioned adjacent to the fourth end portion of the second shield segment, the second coupling structure cooperates with the fourth coupling structure to couple the second end portion to the fourth end portion.

11 Claims, 9 Drawing Sheets

CIRCULAR SAW BLADE PROTECTOR

FIELD

This patent relates generally to saw blade protectors, and particularly to protectors for circular saw blades.

BACKGROUND

Circular saw blades typically include a circular body portion and a cutting portion positioned at the peripheral edge of the body portion. Generally, a circular saw blade is configured to cut one or more particular materials. For example, a circular saw blade configured to cut building materials, such as wood and wood products, includes a cutting portion that has numerous cutting teeth. Whereas, a circular saw blade configured to cut masonry products, includes a toothless cutting portion that is coated with industrial diamonds.

The cutting portion of each type of circular saw blade may become damaged if the blade is dropped or otherwise mishandled. Accordingly, circular saw blades are frequently positioned within a saw blade protector in order to protect the cutting portion during transportation of the saw blade and also while the saw blade is displayed at the point of sale.

Currently available circular saw blade protectors work well to protect the cutting portion; however, further advancements are possible. For example, plastic "clam-shell" type saw blade protectors completely surround the body portion and the cutting portion of the saw blade. These types of protectors are often expensive to manufacture and are generally viewed as being difficult for the consumer to remove. Another type of currently available circular saw blade protector is referred to as a sleeve protector. The sleeve protector is an envelope made of plastic or stiff paper. A circular saw blade is generally easy to remove from the sleeve protector; however, the sleeve protector obscures the cutting portion from view of the consumer. Accordingly, it would be desirable to provide a circular saw blade protector that adequately protects the cutting portion, is comparatively inexpensive to manufacture, and allows inspection of the cutting portion at the point of sale.

SUMMARY

According to one embodiment of the present disclosure there is provided a protector assembly. The protector assembly includes a first shield segment defining a first blade space. The first shield segment includes a first channel structure defining a first channel facing the first blade space. The protector assembly further includes a second shield segment defining a second blade space. The second shield segment includes a second channel structure defining a second channel facing the second blade space. The first shield segment further includes (i) a first end portion that includes a first coupling structure, and (ii) a second end portion that includes a second coupling structure. The second shield segment further includes (i) a third end portion that includes a third coupling structure, and (ii) a fourth end portion that includes a fourth coupling structure. When the first end portion of the first shield segment is positioned adjacent to the third end portion of the second shield segment, the first coupling structure cooperates with the third coupling structure to couple the first end portion to the third end portion. When the second end portion of the first shield segment is positioned adjacent to the fourth end portion of the second shield segment, the second coupling structure cooperates with the fourth coupling structure to couple the second end portion to the fourth end portion.

According to another embodiment of the present disclosure there is provided a protector assembly. The protector assembly includes a first arcuate shield segment defining a first blade space, the first arcuate shield segment including a first arcuate channel structure defining a first arcuate channel facing the first blade space. The protector assembly further includes a second arcuate shield segment defining a second blade space, the second arcuate shield segment including a second arcuate channel structure defining a second arcuate channel facing the second blade space. The first arcuate shield segment includes (i) a first end portion that includes one of a first post and a first receptacle structure, and (ii) a second end portion that includes one of a second post and a second receptacle structure. The second shield segment includes (i) a third end portion that includes the other of the first post and the first receptacle structure, and (ii) a fourth end portion that includes the other of the second post and the second receptacle structure. When the first end portion of the first shield segment is positioned adjacent to the third end portion of the second shield segment, the first post and the first receptacle structure cooperate with each other to couple the first end portion to the third end portion. When the second end portion of the first shield segment is positioned adjacent to the fourth end portion of the second shield segment, the second post and the second receptacle structure cooperate with each other to couple the second end portion to the fourth end portion.

According to yet another embodiment of the present disclosure there is provided a protector assembly. The protector assembly includes a first shield segment defining a first blade space, the first shield segment including a first channel structure defining a first channel facing the first blade space. The protector assembly further includes a second shield segment defining a second blade space, the second shield segment including a second channel structure defining a second channel facing the second blade space. The first shield segment includes (i) a first end portion that includes a first coupling structure, and (ii) a second end portion. The second shield segment includes (i) a third end portion that includes a second coupling structure, and (ii) a fourth end portion that is attached to the second end portion. When the first end portion of the first shield segment is positioned adjacent to the third end portion of the second shield segment, the first coupling structure cooperates with the second coupling structure to couple the first end portion to the third end portion.

BRIEF DESCRIPTION OF THE FIGURES

The above-described features and advantages, as well as others, should become more readily apparent to those of ordinary skill in the art by reference to the following detailed description and the accompanying figures in which.

DETAILED DESCRIPTION

Figure 1:
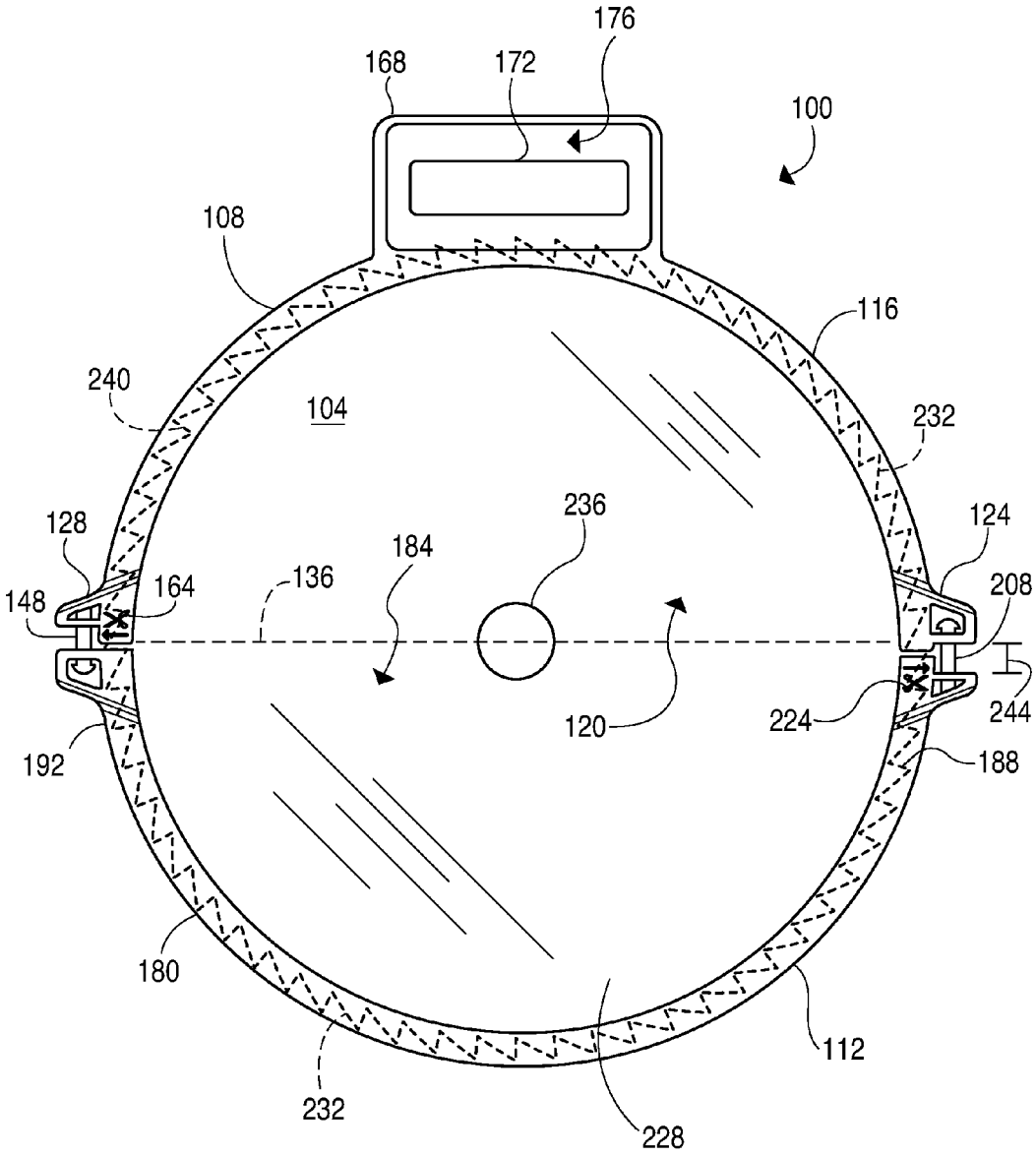
FIG. 1 is a front elevational view of a circular saw blade and a circular saw blade protector.

As shown in FIG. 1, a circular saw blade protector 100 for protecting a circular saw blade 104 includes an upper shield segment, shown as an upper shield 108, and a lower shield segment, shown as a lower shield 112.

Figure 2:
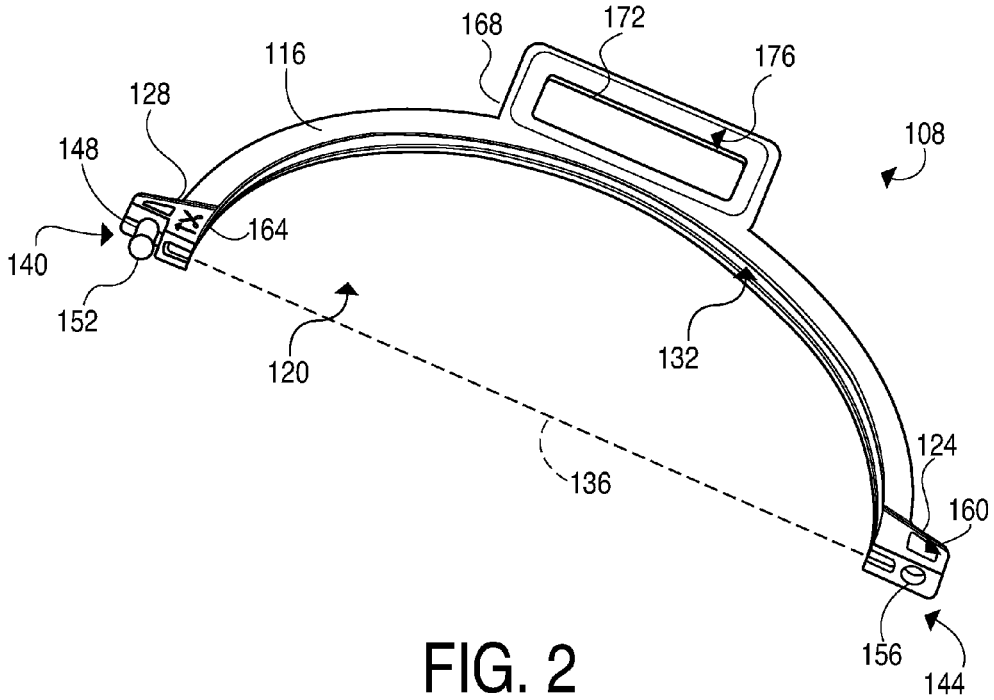
FIG. 2 is a perspective view of an upper shield of the circular saw blade protector of FIG. 1, with the circular saw blade removed for clarity of viewing.
Figure 3:
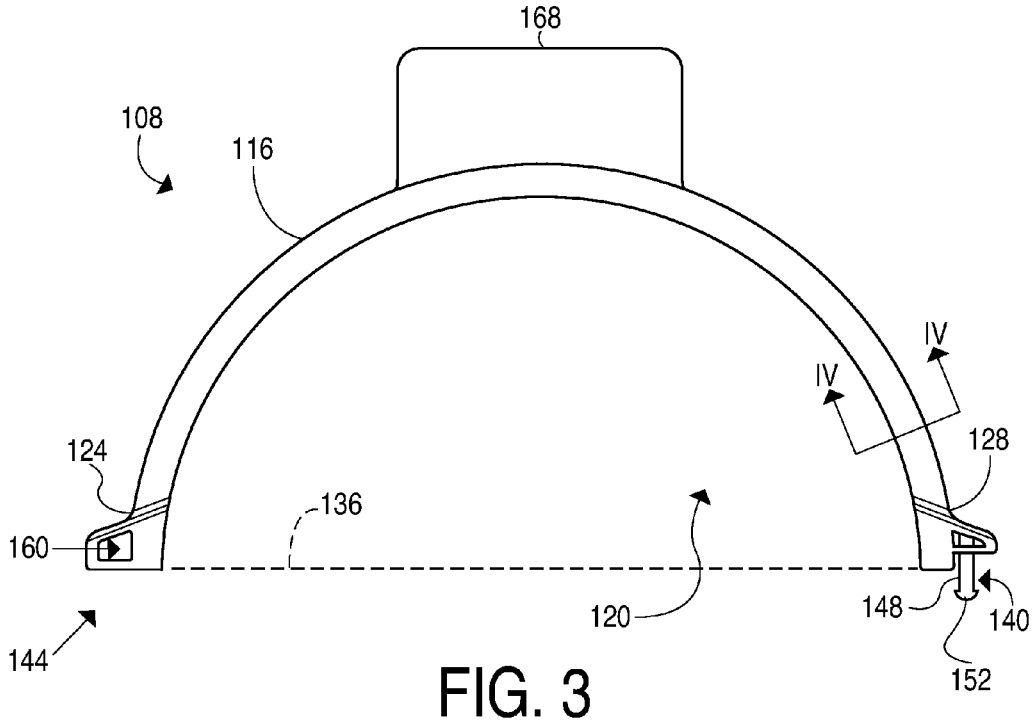
FIG. 3 is a rear elevational view of the upper shield of FIG. 2.

In FIGS. 2 and 3, the upper shield 108 is shown apart from the lower shield 112 and with the saw blade 104 removed. The upper shield 108 includes a generally arc-shaped or arcuate structure, which is configured to extend for approximately 180° around the periphery of the saw blade 104. The upper shield 108 is formed from a material, which transmits light, such as injection molded thermoplastic. The upper shield 108 is, therefore, transparent or translucent and a portion of the saw blade 104 is visible through the material of the upper shield.

The upper shield 108 includes a channel structure 116 and defines a blade space 120. The channel structure 116 extends from a left end portion 124 of the upper shield 108 (shown on the right side of FIGS. 1 and 2) to a right end portion 128 of the upper shield 108 (shown on the left side of FIGS. 1 and 2). The channel structure 116 is generally arc-shaped and defines an upper channel 132, which faces the blade space 120.

Figure 4:
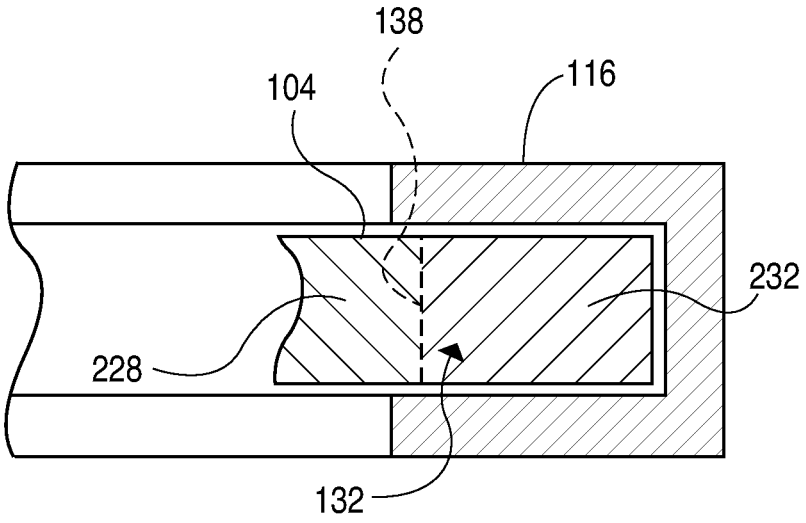
FIG. 4 is a cross sectional view taken along the line IV-IV of FIG. 3, including a fragmentary view of a portion of the circular saw blade, which is also shown in cross section.

As shown in FIG. 4, a cross section of the channel structure 116 shows the generally "U"-shaped upper channel 132. The portion of the blade 104 positioned within the upper channel 132 is shown to the right of the broken line 138 and is referred to as a cutting portion 232 of the blade. The channel structure 116 surrounds the cutting portion 232, but enables viewing of the cutting portion through the light-transmissive material of the channel structure.

As shown in FIGS. 1-3, the blade space 120 includes a semi-circle shaped area bounded by the channel structure 116 and the reference line 136. An upper portion of a body 228 of the blade 104 (i.e. the portion of the blade 104, which is positioned above the reference line 136) is positioned within the blade space 120.

As shown in FIG. 2, the right end portion 128 of the upper shield 108 includes a coupling structure, shown as a post 140, and the left end portion 124 of the upper shield includes another coupling structure, shown as a receptacle 144. The post 140 is configured to cooperate with a right coupling structure of the lower shield 112. The post 140 includes a shaft 148 terminated with a bulb 152. As shown best in FIG. 3, the shaft 148 is spaced apart from the channel structure 116 to enable a cutting instrument, such as a pair of scissors, to access and cut the shaft. The bulb 152 has a width that is wider than that of the shaft 148.

The receptacle 144 defines an opening 156 and a space 160 configured to receive at least a portion of a left connection structure of the lower shield 112, thereby connecting the left end portion 124 to a portion of the lower shield 112.

An image 164 of a pair of scissors and an arrow pointing toward the shaft 148 is formed into the right end portion 128. The image 164 is a reference image, which identifies to the user of the saw blade 104 and saw blade protector 100 a region suitable for cutting to remove the saw blade protector from the blade (as explained below in detail). It is noted that, other embodiments of the upper shield 108 do not include the image 164.

The upper shield 108 further includes a display structure 168 and a security sensor 172 attached to the display structure. The display structure 168 is made of the same light-transmissive material as the rest of the upper shield 108 and is configured to extend outwardly away from the channel structure 116. The display structure 168 defines a field 176 in which the security sensor 172 is positioned. In an alternative embodiment, the display structure 168 includes a hanger opening (not shown) to receive a hanger unit (not shown) configured to support the blade 104 and the saw blade protector 100.

The security sensor 172 is positioned in the field 176 defined by the display structure 168. The security sensor 172 includes a radio frequency identification tag. In other embodiments, however, the security sensor 172 includes another type of security device. Also, in another embodiment, an adhesive label (not shown) is placed to cover the field 176 and the security sensor 172, such that the security sensor remains functional, but not visible to the user.

Figure 5:
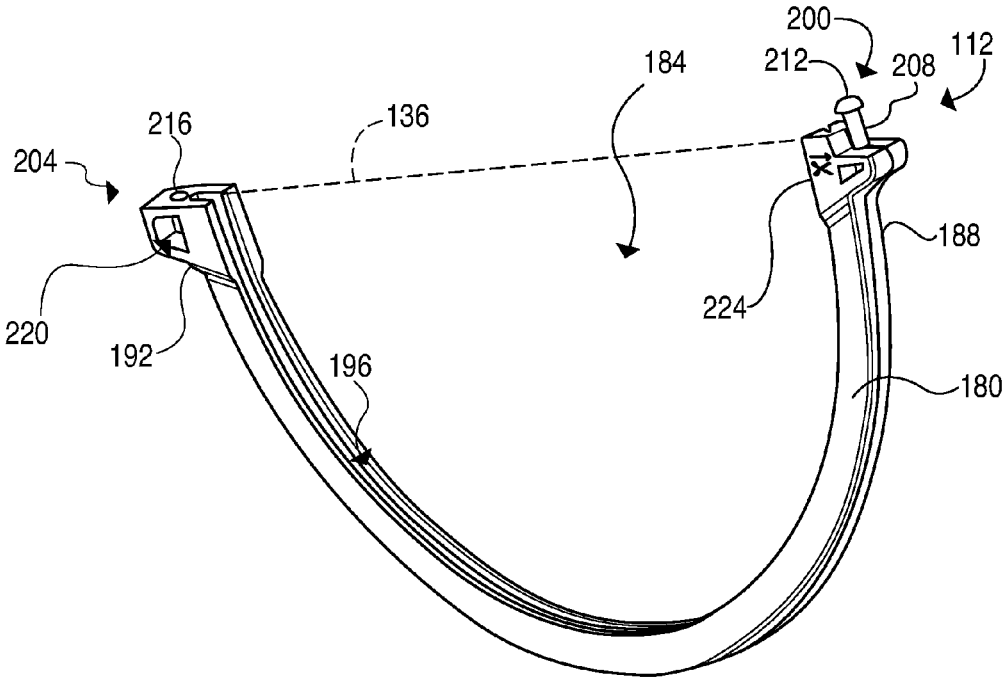
FIG. 5 is a perspective view of a lower shield of the circular saw blade protector of FIG. 1, with the circular saw blade removed for clarity of viewing.
Figure 6:
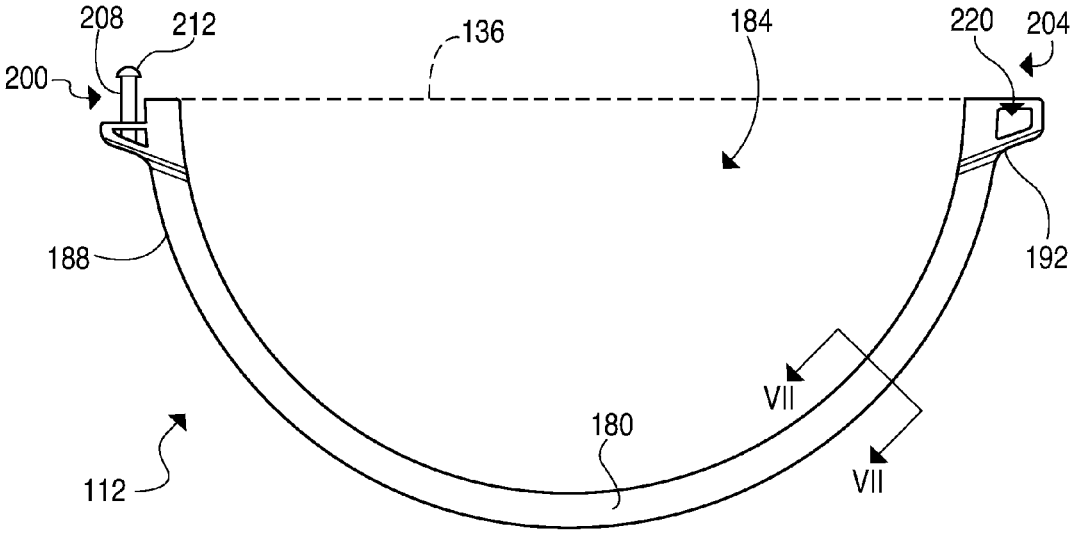
FIG. 6 is a rear elevational view of the lower shield of FIG. 5.

As shown in FIGS. 5 and 6, the lower shield 112 includes a generally arc-shaped or arcuate structure, which is configured to extend for approximately 180° around the periphery of the saw blade 104. The lower shield 112 is formed form the same light-transmissive material as the upper shield 108. The lower shield 112 is, therefore, transparent or translucent and the cutting portion 232 of the saw blade 104 is visible through the material of the lower shield.

The lower shield 112 includes a channel structure 180 and defines a blade space 184. The channel structure 180 extends from a left end portion 188 of the lower shield 112 (shown on the right side of FIGS. 1 and 5) to a right end portion 192 of the lower shield (shown on the left side of FIGS. 1 and 5). The channel structure 180 is generally arc-shaped and defines a lower channel 196, which faces the blade space 184.

Figure 7:
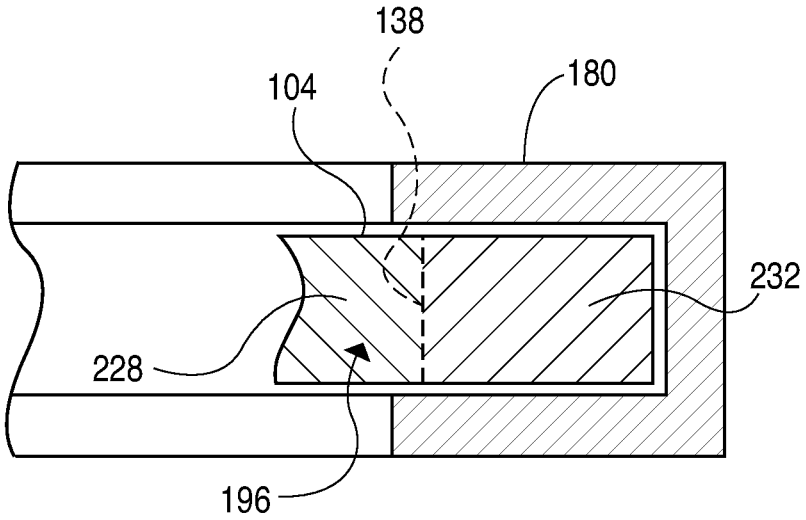
FIG. 7 is a cross sectional view taken along the line VII-VII of FIG. 6, including a fragmentary view of a portion of the circular saw blade, which is also shown in cross section.

As shown in FIG. 7, a cross section of the channel structure 180 shows the generally "U"-shaped lower channel 196. The cutting portion 232 (to the right of broken line 138) of the blade 104 is positioned within the lower channel 196. The channel structure 180 surrounds the cutting portion 232, but enables viewing of the cutting portion through the material of the channel structure.

As shown in FIGS. 1, 5, and 6, the blade space 184 includes a semi-circle shaped area bounded by the channel structure 180 and the reference line 136. A lower portion of the body 228 of the blade 104 (that which is positioned below the reference line 136) is positioned within the blade space 184.

As shown in FIGS. 5 and 6, the left end portion 188 of the lower shield 112 includes a coupling structure, shown as a post 200, and the right end portion 192 of the lower shield includes another coupling structure, shown as a receptacle 204. The post 200 includes a shaft 208 terminated with a bulb 212. As shown best in FIG. 6, the shaft 148 is spaced apart from the channel structure 180 to enable a cutting instrument, such as a pair of scissors, to access and cut the shaft. The post 200 is configured to engage the receptacle 144 of the upper shield 108. In particular, the bulb 212 passes through the opening 156 and into the space 160 to connect the left end portion 124 to the left end portion 188. The bulb 212 has a width that is wider than that of the shaft 208; accordingly, after the bulb 212 passes through the opening 156, the receptacle 144 retains the bulb within the space 160 and the shaft 208 extends through the opening 156.

The receptacle 204 defines an opening 216 and a space 220 configured to receive and retain the bulb 152 of the post 140 of the upper shield 108, thereby connecting the right end portion 128 to the right end portion 192. When the right end portion 128 is connected to the right end portion 192, the bulb 152 is positioned in the space 220 and the shaft 148 extends through the opening 216.

As shown in FIG. 1, the lower shield 112 also includes an image 224 of a pair of scissors and an arrow pointing toward the shaft 208. The image is formed into the left end portion 188, and functions identically to the image 164.

The saw blade 104 has a body 228, a cutting portion 232, and an arbor opening 236. The body 228 includes a circular disk and the arbor opening 236 is positioned in the middle of the body. An upper portion of the body 228 is positioned in the blade space 120 of the upper shield 108 and a lower portion of the body is positioned in the blade space 184 of the lower shield 112. The cutting portion 232 is positioned around the periphery of the body 228. As shown in FIG. 1, the cutting portion 232 includes a plurality of cutting teeth 240. In other embodiments of the blade 104, the cutting portion 232 includes a different cutting portion, such as a cutting surface that includes industrial diamonds or carbide tipped cutting teeth.

In operation, the circular saw blade protector 100 is configured to protect the circular saw blade 104 during transportation of the blade and during display of the blade at the point of sale, among other times and locations. At the point of sale, a hanger unit (not shown) is inserted through the arbor opening 236 to support the blade 104 and the saw blade protector 100. The saw blade protector 100 prevents the cutting portion 232 from being damaged due to mishandling of the saw blade 104. Specifically, the material of the upper shield 108 and the lower shield 112 absorbs shock and resists deformation, thereby preventing damage to the cutting portion 232.

The saw blade protector 100 enables the cutting portion 232 of the blade 104 to be visible through the material of the upper shield 108 and the lower shield 112. Accordingly, a potential purchaser of the blade 104 is able to inspect the configuration and construction of the cutting portion 232 without having to the remove the blade 104 from the saw blade protector 100. Also, the security sensor 172 remains associated with the blade 104 during the potential purchaser's inspection of the blade. The potential purchaser is also referred to as a user.

To associate the saw blade protector 100 with the blade 104, first a lower portion of the cutting portion 232 is inserted into the lower channel 196 defined by the lower shield 112. Second, an upper portion of the cutting portion 232 is inserted into the upper channel 132 defined by the upper shield 108. Next, the left end portion 124 is moved toward the left end portion 188 and the right end portion 128 is moved toward the right end portion 192.

When the left end portion 124 is positioned adjacent to the left end portion 188, the bulb 212 of the post 200 is aligned with the opening 156 of the receptacle 144. Continued movement of the left end portion 124 toward the left end portion 188 causes the bulb 212 to pass through the opening 156 and to enter and be retained within the space 160. The shape of the bulb 212 prevents the bulb from being withdrawn from the space 160 through the opening 156. Therefore, when the post 200 is received by the receptacle 144, the left end portion 124 is "permanently" connected to the left end portion 188, as shown in FIG. 1. A "permanent" connection means that the left end portion 124 cannot be separated from the left end portion 188 without destroying one or more of the post 200 and the receptacle 144.

Similarly, when the right end portion 128 is positioned adjacent to the right end portion 192, the bulb 152 of the post 140 is aligned with the opening 216 of the receptacle 204. Continued movement of the right end portion 128 toward the right end portion 192 causes the bulb 152 to pass through the opening 216 and to enter and be retained within the space 220. The shape of the bulb 152 prevents the bulb from being withdrawn from the space 220 through the opening 216. Therefore, when the post 140 is received by the receptacle 204, the right end portion 128 is "permanently" connected to the right end portion 192, as shown in FIG. 1. Also, the upper blade space 120 and the lower blade space 184 are interposed between the upper channel structure 116 and the lower channel structure 180.

After the upper shield 108 is connected to the lower shield 112, the upper shield cannot be separated from the lower shield without destroying at least a portion of one or more of the post 140, the post 200, the receptacle 144, the receptacle 204, the channel structure 116, and the channel structure 180. The non-separable nature of the saw blade protector 100 helps to ensure that the security sensor 172 remains associated with the blade 104 until blade is purchased. The non-separable nature of the saw blade protector 100 also helps to ensure that the cutting portion 232 of the blade 104 remains protected until the blade is purchased and the saw blade protector 100 is removed.

To disassociate the saw blade protector 100 from the saw blade 104, the shaft 148 of the post 140 and/or the shaft 208 of the post 200 are cut. As shown in FIG. 1, when the upper shield 108 is connected to the lower shield 112, the left end portion 124 is positioned apart from the left end portion 188 by the distance represented by the reference line 244. The shaft 208 is exposed in this region and is easily cut with a pair of scissors or a knife. The arrow of the image 224 points to this portion of the shaft 208, thereby signaling to the user the preferred location in which to cut the saw blade protector 100 when removing the saw blade protector from the blade 104. After the shaft 208 is cut, the upper shield 108 and the lower shield 112 are bent and moved to enable the blade 104 to be removed from the saw blade protector 100. To further simplify the disassociation of the blade 104 from the saw blade protector 100, however, the shaft 148 is cut in a similar manner to enable separation of the upper shield 108 from the lower shield 112.

Figure 8:
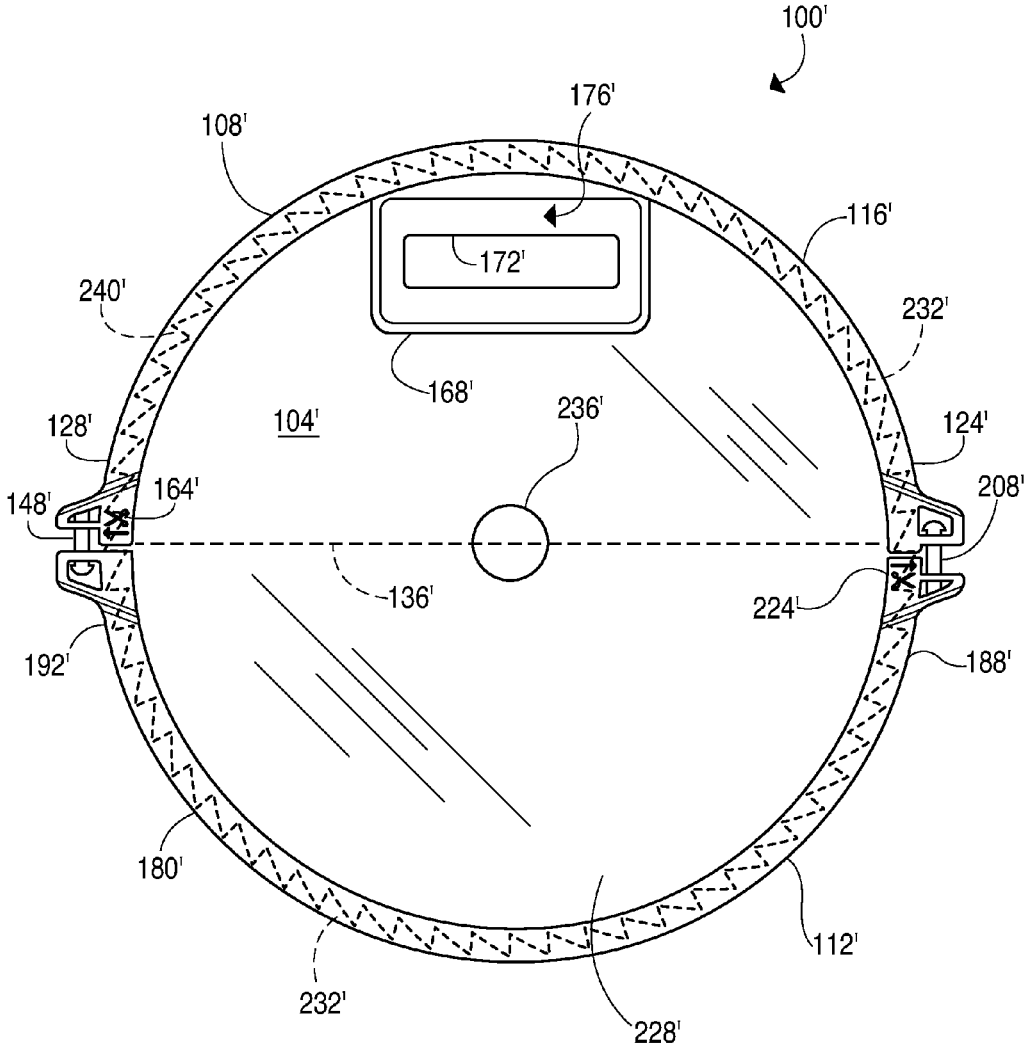
FIG. 8 is a front elevational view of a circular saw blade and an alternative embodiment of the saw blade protector of FIG. 1.

As shown in FIG. 8, another embodiment of a saw blade protector 100' is disclosed. The saw blade protector 100' includes the same components, functions the same way, and is used with the same blade 104' as the saw blade protector 100, except that the saw blade protector 100' includes a display structure 168', which extends downwardly toward the lower shield 112'. The display structure 168' is otherwise the same as the display structure 168 of the upper shield 108.

Figure 9:
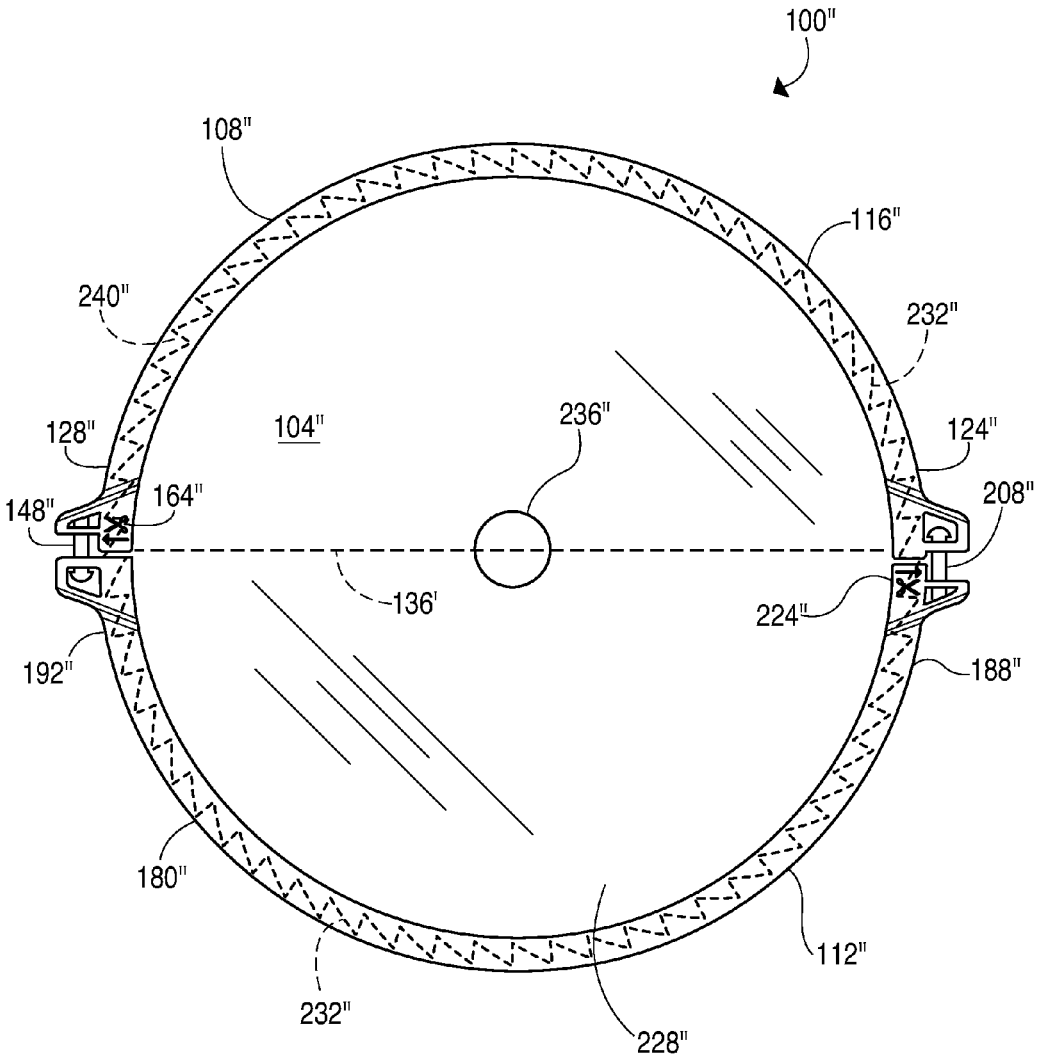
FIG. 9 is a front elevational view of a circular saw blade and yet another alternative embodiment of the saw blade protector of FIG. 1.

As shown in FIG. 9, yet another embodiment of a saw blade protector 100" is disclosed. The saw blade protector 100" includes the same components, functions the same way, and is used with the same blade 104" as the saw blade protector 100, except that the upper shield 108" does not include the display structure 168. Accordingly, the upper shield 108" and the lower shield 112" are identical to one another. Specifically, in FIG. 9, the upper shield 108" is positioned in a first orientation, and the lower shield 112" is another of the upper shield 108" that is in a horizontally inverted position. The identical nature of the upper shield 108" and the lower shield 112" simplifies the manufacturing and assembly of the saw blade protector 100".

Figure 10:
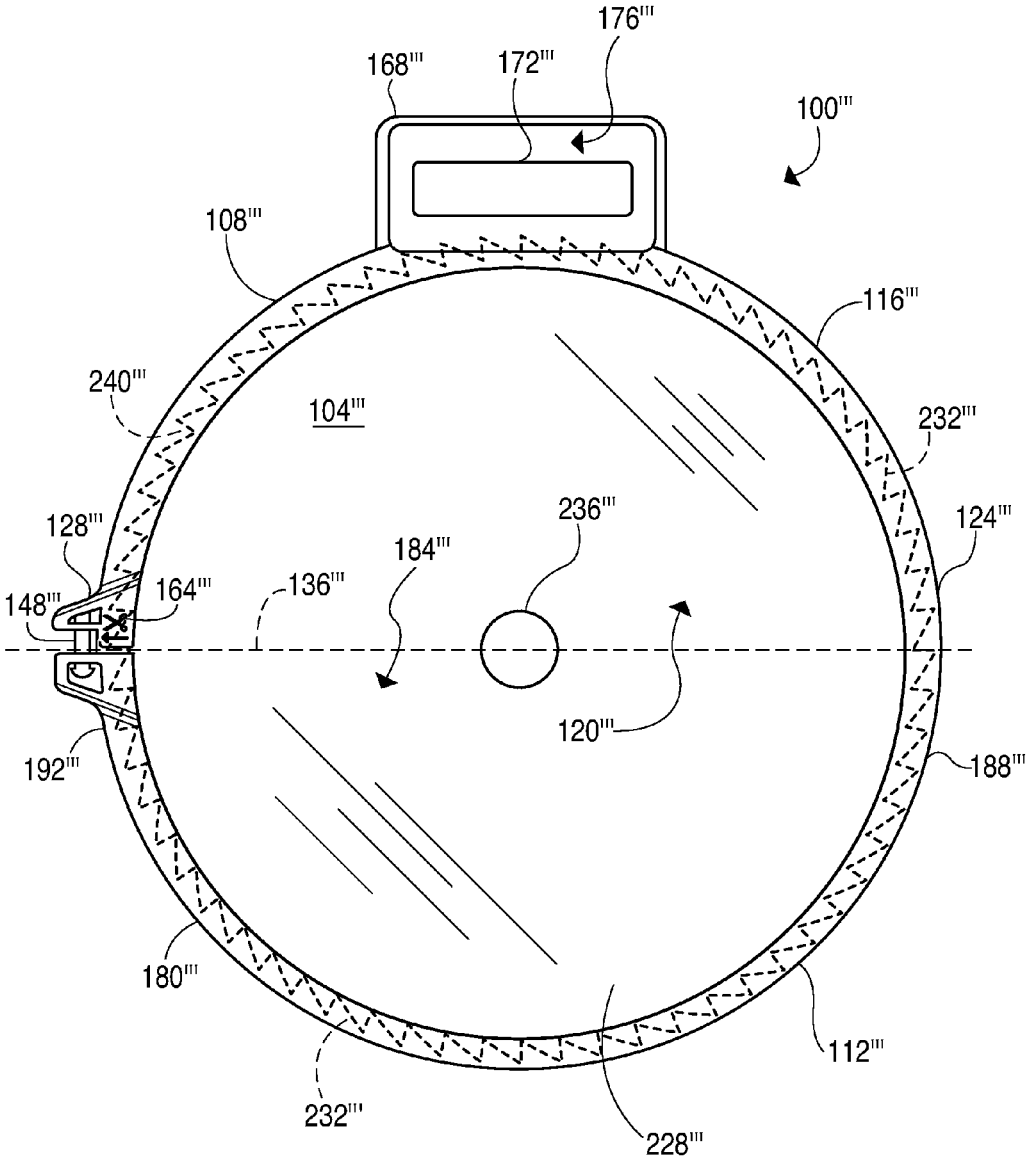
FIG. 10 is a front elevational view of a circular saw blade and still another alternative embodiment of the circular saw blade protector of FIG. 1, with the circular saw blade protector shown in a closed position.
Figure 11:
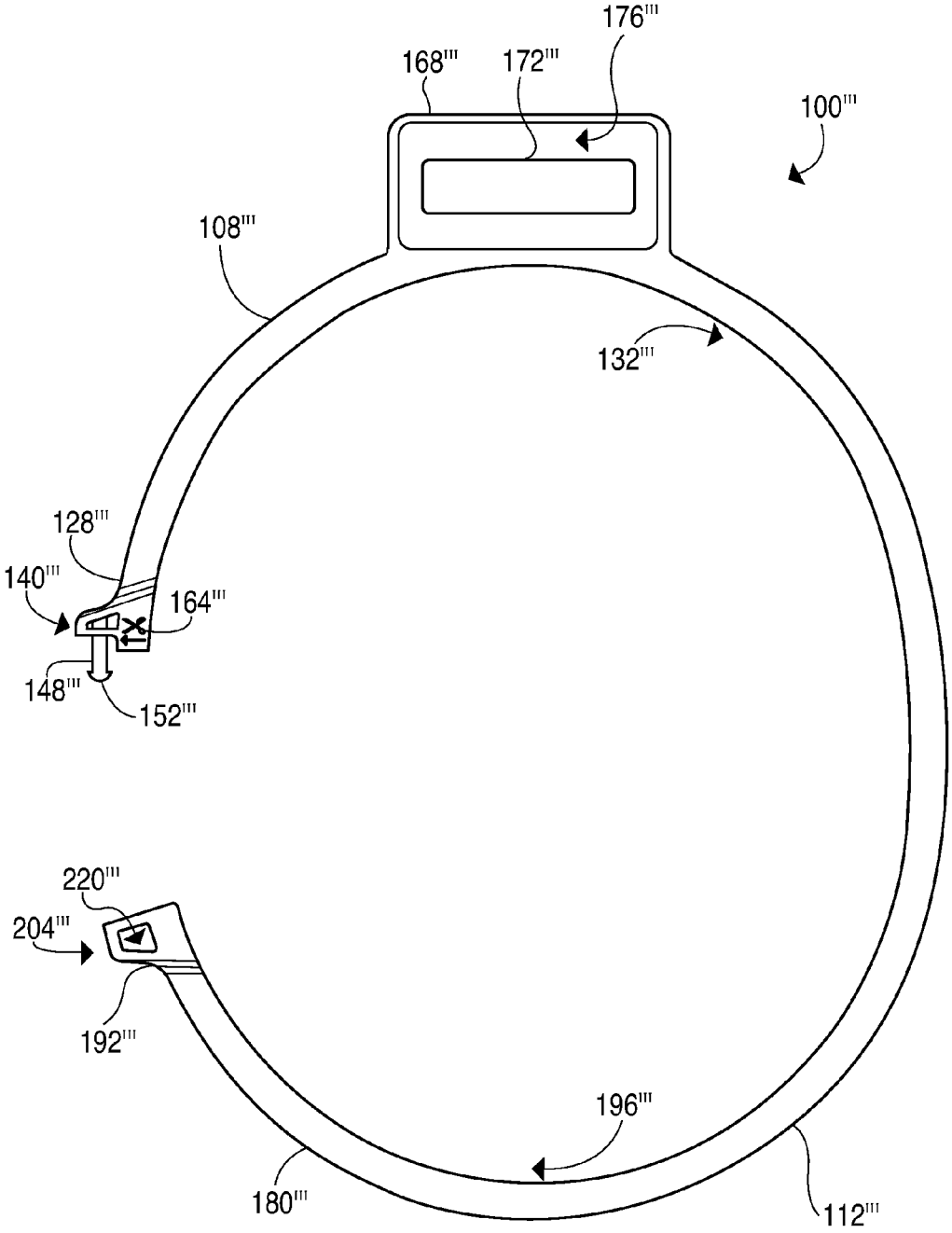
FIG. 11 is a front elevational view of the saw blade protector of FIG. 10 shown in an open position with the circular saw blade removed for clarity of viewing.

As shown in FIGS. 10 and 11, still another embodiment of a circular saw blade protector 100''' is disclosed. Components of the saw blade protector 100''' that are identical or are substantially the same as the components of the saw blade protector 100 include like reference numerals terminated with three prime symbols (''')). Unlike the saw blade protector 100 shown in FIGS. 1-7, which includes the upper shield 108 that is completely separable from the lower shield 112, the saw blade protector 100''' includes an upper shield 108''' and a lower shield 112''', which are integrally formed together as a single monolithic part. Specifically, the left end portion 124''' of the upper shield 112''' is attached to the left end portion 188''' of the lower shield 112'''.

The saw blade protector 100''' is formed from a resilient and light-transmissive material. The resiliency of the saw blade protector 100''' enables the saw blade protector to return to the shape as shown in FIG. 10 after being bent, twisted, or otherwise deformed. Note, however, that the material of the saw blade protector 100''' also enables the saw blade protector to prevent the cutting portion 232''' from being damaged due to mishandling of the saw blade 104'''. Specifically, the material of the saw blade protector 100''' absorbs shock and resists deformation, thereby preventing damage to the cutting portion 232'''.

The light-transmissive nature of the saw blade protector 100''' enables the cutting portion 232''' of the saw blade 104''' to be visible through the material of the saw blade protector. An exemplary material for forming the saw blade protector 100''' includes injection molded thermoplastic. Since the upper shield 108' and the lower shield 112' are a single part, the entire saw blade protector 100''' may be formed in a "one-shot" injection molding process.

To associate the saw blade protector 100''' with the circular saw blade 104''', first the right end portion 192''' is moved away from the right end portion 128''' to position the saw blade protector approximately as shown in FIG. 11. The position of the saw blade protector 100''' in FIG. 11 approximately resembles a horizontally-inverted "C" shape. Next, the upper portion of the saw blade 104''' is positioned in the upper channel 132''' defined by the upper shield 108'''. Thereafter, the right end portion 192''' is moved toward the right end portion 128''', which causes the lower portion of the saw blade 104''' to be positioned in the lower channel 196''' in the lower shield 112'''.

When the right end portion 128''' is positioned adjacent to the right end portion 192''', the bulb 152''' of the post 140''' is aligned with the opening 216''' of the receptacle 204'''. Continued movement of the right end portion 128''' toward the right end portion 192''' causes the bulb 152''' to pass through the opening 216''' and to enter and be retained within the space 220'''. The shape of the bulb 152''' prevents the bulb from being withdrawn from the space 220''' through the opening 216'''. Therefore, when the post 140''' is received by the receptacle 204''', the right end portion 128''' is "permanently" connected to the right end portion 192''', as shown in FIG. 10.

To disassociate the saw blade protector 100''' from the circular saw blade 104''' the shaft 148''' of the post 140''' is cut. After the shaft 148''' is cut, the upper shield 108''' and the lower shield 112''' are bent and moved to approximately the position shown in FIG. 10 to enable the blade 104''' to be removed from the saw blade protector 100'''.

Although not illustrated in FIGS. 10 and 11, in some embodiments of the circular saw blade protector 104' the left end portion 124' and the left end portion 188''' are removably attached together. In this embodiment of the saw blade protector 104', the left end portion 124''' includes a coupling structure (not shown) and the left end portion 188''' includes a coupling structure (not shown). The coupling structure of the left end portion 124''' is configured to removably receive the coupling structure of the left end portion 188'''.

It is noted that while the coupling structures in each of the circular saw blade protectors 100, 100', 100", 100''' have been shown as posts 140, 140', 140", 140''' and receptacles 204, 204', 204", 204''', in other embodiments of the circular saw blade protector the coupling structures are any elements configured to be "permanently" attached to each other.

While the saw blade protector 100, 100', 100", 100''' has been illustrated and described in detail in the figures and the foregoing description, the same should be considered as illustrative and not restrictive in character. It should be understood that only the preferred embodiments have been presented and that all changes, modifications, and further application that come within the spirit of the disclosure are desired to be protected.

What is claimed is:

1. A protector assembly, comprising:

a first shield segment defining a first blade space, said first shield segment including a first channel structure defining a first channel facing said first blade space; and a second shield segment defining a second blade space, said second shield segment including a second channel structure defining a second channel facing said second blade space, wherein said first shield segment includes (i) a first end portion that includes a first coupling structure, and (ii) a second end portion that includes a second coupling structure, wherein said second shield segment includes (i) a third end portion that includes a third coupling structure, and (ii) a fourth end portion that includes a fourth coupling structure, wherein, when said first end portion of said first shield segment is positioned adjacent to said third end portion of said second shield segment, said first coupling structure cooperates with said third coupling structure to permanently connect said first end portion to said third end portion so that said first coupling structure cannot be disconnected from said third coupling structure without destroying one or more of said first coupling structure and said third coupling structure, and wherein, when said second end portion of said first shield segment is positioned adjacent to said fourth end portion of said second shield segment, said second coupling structure cooperates with said fourth coupling structure to permanently connect said second end portion to said fourth end portion so that said second coupling structure cannot be disconnected from said fourth coupling structure without destroying one or more of said second coupling structure and said fourth coupling structure, further comprising a circular saw blade having a body and a plurality of teeth positioned around said body, wherein said body is located within said first blade space and said second blade space, wherein said plurality of teeth are positioned in said first channel and said second channel, wherein said first coupling structure includes one of a first post and a first receptacle structure, wherein said third coupling structure includes the other of said first post and said first receptacle structure, wherein said second coupling structure includes one of a second post and a second receptacle structure, and wherein said fourth coupling structure includes the other of said second post and said second receptacle structure.

2. A protector assembly, comprising:

a first shield segment defining a first blade space, said first shield segment including a first channel structure defining a first channel facing said first blade space; and a second shield segment defining a second blade space, said second shield segment including a second channel structure defining a second channel facing said second blade space, wherein said first shield segment includes (i) a first end portion that includes a first coupling structure, and (ii) a second end portion that includes a second coupling structure, wherein said second shield segment includes (i) a third end portion that includes a third coupling structure, and (ii) a fourth end portion that includes a fourth coupling structure, wherein, when said first end portion of said first shield segment is positioned adjacent to said third end portion of said second shield segment, said first coupling structure cooperates with said third coupling structure to permanently connect said first end portion to said third end portion so that said first coupling structure cannot be disconnected from said third coupling structure without destroying one or more of said first coupling structure and said third coupling structure, and wherein, when said second end portion of said first shield segment is positioned adjacent to said fourth end portion of said second shield segment, said second coupling structure cooperates with said fourth coupling structure to permanently connect said second end portion to said fourth end portion so that said second coupling structure cannot be disconnected from said fourth coupling structure without destroying one or more of said second coupling structure and said fourth coupling structure, further comprising a circular saw blade having a body and a plurality of teeth positioned around said body, wherein said body is located within said first blade space and said second blade space, wherein said plurality of teeth are positioned in said first channel and said second channel, wherein said first coupling structure includes a first post, wherein said third coupling structure includes a first receptacle structure that is configured to cooperate with said first post to secure said first end portion of said first shield segment to said third end portion of said second shield segment, wherein said second coupling structure includes a second receptacle structure, and wherein said fourth coupling structure includes a second post that is configured to cooperate with said second receptacle structure to secure said second end portion of said first shield segment to said fourth end portion of said second shield segment.

3. A protector assembly, comprising:

a first arcuate shield segment defining a first blade space, said first arcuate shield segment including a first arcuate channel structure defining a first arcuate channel facing said first blade space; and a second arcuate shield segment defining a second blade space, said second arcuate shield segment including a second arcuate channel structure defining a second arcuate channel facing said second blade space, wherein said first arcuate shield segment includes (i) a first end portion that includes one of a first post and a first receptacle structure, and (ii) a second end portion that includes one of a second post and a second receptacle structure, wherein said second shield segment includes (i) a third end portion that includes the other of said first post and said first receptacle structure, and (ii) a fourth end portion that includes the other of said second post and said second receptacle structure, wherein, when said first end portion of said first shield segment is positioned adjacent to said third end portion of said second shield segment, said first post and said first receptacle structure cooperate with each other to permanently connect said first end portion to said third end portion so that said first post cannot be disconnected from said first receptacle without destroying one or more of said first post and said first receptacle, and wherein, when said second end portion of said first shield segment is positioned adjacent to said fourth end portion of said second shield segment, said second post and said second receptacle structure cooperate with each other to permanently connect said second end portion to said fourth end portion so that said second post cannot be disconnected from said second receptacle without destroying one or more of said second post and said second receptacle, further comprising a circular saw blade having a body and a plurality of teeth positioned around said body, wherein:

said body is located within said first blade space and said second blade space, and said plurality of teeth are positioned in said first arcuate channel and said second arcuate channel.

4. The protector assembly of claim 3, wherein said first shield segment and said second segment are each configured to extend for about 180°.

5. The protector assembly of claim 3, wherein said first blade space and said second blade space are interposed between said first arcuate channel structure and said second arcuate channel structure.

6. The protector assembly of claim 3, wherein:

said first channel extends from said first end portion of said first shield segment to said second end portion of said first shield segment, and said second channel extends from said third end portion of said second shield segment to said fourth end portion of said second shield segment.

7. The protector assembly of claim 3, wherein:

said first shield segment includes a display structure extending outwardly away from said first arcuate channel, and said display structure is configured to support a security sensor thereon.

8. The protector assembly of claim 7, further comprising a security sensor attached to said display structure.

9. The protector assembly of claim 3, wherein each of said first shield segment and said second shield segment are made of a transparent material so that said plurality of teeth are visible through said first shield segment and said second shield segment.

10. The protector assembly of claim 3, wherein:

said first post is configured to be substantially identical to said second post, and said first receptacle is configured to be substantially identical to said second receptacle.

11. A protector assembly, comprising:

a first shield segment defining a first blade space, said first shield segment including a first channel structure defining a first channel facing said first blade space; and a second shield segment defining a second blade space, said second shield segment including a second channel structure defining a second channel facing said second blade space, wherein said first shield segment includes (i) a first end portion that includes a first coupling structure, and (ii) a second end portion, wherein said second shield segment includes (i) a third end portion that includes a second coupling structure, and (ii) a fourth end portion that is attached to said second end portion, and wherein, when said first end portion of said first shield segment is positioned adjacent to said third end portion of said second shield segment, said first coupling structure cooperates with said second coupling structure to permanently connect said first end portion to said third end portion so that said first coupling structure cannot be disconnected from said second coupling structure without destroying one or more of said first coupling structure and said second coupling structure, further comprising a circular saw blade having a body and a cutting portion positioned around said body, wherein:

said body is located within said first blade space and said second blade space, said cutting portion are positioned in said first channel and said second channel, said first coupling structure includes a post, said second coupling structure includes a receptacle structure that is configured to cooperate with said post to secure said first end portion of said first shield segment to said third end portion of said second shield segment.

* * * * *